US008752406B2

(12) United States Patent
Shute et al.

(10) Patent No.: US 8,752,406 B2
(45) Date of Patent: Jun. 17, 2014

(54) SECURITY DEVICE FOR PRODUCTS ON A DISPLAY CARD

(75) Inventors: Matthew R. Shute, Charlotte, NC (US); Mark Ezzo, Tyler, TX (US)

(73) Assignee: Checkpoint Systems, Inc., Thorofare, NJ (US)

( * ) Notice: Subject to any disclaimer, the term of this patent is extended or adjusted under 35 U.S.C. 154(b) by 197 days.

(21) Appl. No.: 13/315,044

(22) Filed: Dec. 8, 2011

(65) Prior Publication Data

US 2012/0144882 A1 Jun. 14, 2012

Related U.S. Application Data

(60) Provisional application No. 61/421,112, filed on Dec. 8, 2010.

(51) Int. Cl.
*E05B 73/00* (2006.01)

(52) U.S. Cl.
USPC ..... 70/14; 70/57.1; 70/58; 206/6.1

(58) Field of Classification Search
USPC ..... 70/14, 57.1, 57, 58; 206/6.1
See application file for complete search history.

(56) References Cited

U.S. PATENT DOCUMENTS

| | | | | |
|---|---|---|---|---|
| 3,927,765 | A | 12/1975 | Beal | |
| 4,300,674 | A | 11/1981 | Davet | |
| 4,682,690 | A | 7/1987 | Tiffany | |
| 4,739,878 | A * | 4/1988 | DiDomenico | 206/6.1 |
| 5,119,652 | A * | 6/1992 | Costa | 70/57.1 |
| 5,535,878 | A * | 7/1996 | Reed | 206/6.1 |
| 5,873,457 | A * | 2/1999 | Madweb | 206/301 |
| 6,199,309 | B1 * | 3/2001 | Markarian | 40/299.01 |
| 6,279,358 | B1 * | 8/2001 | Costa | 70/57.1 |
| 6,631,629 | B1 | 10/2003 | Fuss et al. | |
| 6,755,055 | B2 * | 6/2004 | Sedon et al. | 70/57.1 |
| 6,848,285 | B2 | 2/2005 | Stroh | |
| 6,896,133 | B2 | 5/2005 | Spagna | |
| 6,905,024 | B1 | 6/2005 | Cao et al. | |

(Continued)

FOREIGN PATENT DOCUMENTS

| | | |
|---|---|---|
| EP | 0277076 | 8/1988 |
| EP | 0311725 | 4/1989 |

(Continued)

OTHER PUBLICATIONS

International Search Report and Written Opinion from International Application No. PCT/US2011/063899, mailed Mar. 15, 2012.

*Primary Examiner* — Suzanne Barrett
(74) *Attorney, Agent, or Firm* — Nathaniel T. Quirk

(57) ABSTRACT

Security devices according to the present invention may be configured to secure merchandise supported by a display card. The security device may include a housing defining an aperture configured to receive a secured portion of the article, an engagement member disposed generally proximate the aperture, and a sliding member configured to move the engagement member from the release position to a capture position. The secured portion may be removed from the aperture while the engagement member is in the release position and the secured portion may be inhibited from removal while the engagement member is in the capture position. The engagement member may define an engagement aperture where the secured portion of the article that is received through the aperture of the housing is also received through the engagement aperture of the engagement member.

31 Claims, 15 Drawing Sheets

(56) References Cited

U.S. PATENT DOCUMENTS

| | | | | |
|---|---|---|---|---|
| 7,320,235 | B2 * | 1/2008 | Belden et al. | 70/57.1 |
| 7,458,241 | B2 * | 12/2008 | Belden, Jr. | 70/57.1 |
| 7,464,569 | B2 | 12/2008 | Kolton et al. | |
| 7,537,109 | B1 * | 5/2009 | Shevick | 206/6.1 |
| 7,714,721 | B1 * | 5/2010 | Feibelman et al. | 340/568.1 |
| 8,035,518 | B2 * | 10/2011 | Kolton et al. | 340/572.1 |
| 2002/0174695 | A1 * | 11/2002 | Huehner | 70/57.1 |
| 2005/0268672 | A1 | 12/2005 | Fraser et al. | |
| 2006/0070410 | A1 | 4/2006 | Fuss et al. | |
| 2006/0174667 | A1 | 8/2006 | Garner | |
| 2007/0289344 | A1 * | 12/2007 | Fawcett et al. | 70/58 |
| 2012/0234057 | A1 * | 9/2012 | Feibelman et al. | 70/58 |
| 2012/0326871 | A1 * | 12/2012 | Lian et al. | 340/572.1 |

FOREIGN PATENT DOCUMENTS

| | | | |
|---|---|---|---|
| EP | 1285610 | | 2/2003 |
| FR | 2661022 | | 10/1991 |
| FR | 2715817 | | 8/1995 |
| FR | 2753562 | | 3/1998 |
| FR | 2 766 684 | A1 | 2/1999 |
| FR | 2 779 626 | A1 | 12/1999 |
| FR | 2815371 | | 4/2002 |
| WO | WO 90/14649 | A1 | 11/1990 |
| WO | WO 01/57348 | A1 | 8/2001 |

* cited by examiner

SECURITY DEVICE FOR PRODUCTS ON A DISPLAY CARD

CROSS-REFERENCE TO RELATED APPLICATIONS

The present application claims the benefit of U.S. Provisional Application No. 61/421,112 entitled "Security Device for Products on a Display Card," Filed on Dec. 8, 2010, the contents of which are incorporated herein in their entirety.

FIELD OF THE INVENTION

The present invention relates to security devices used to protect merchandise or other objects and, more particularly, to security devices used to protect products packaged on cardstock, such as earrings or other jewelry.

BACKGROUND

Electronic article surveillance (EAS) systems are often used to deter and detect shoplifting. Typically, an EAS security system includes an EAS element, a transmitter, a receiver, and an alarm. The EAS element is attached to an article of merchandise. The transmitter and the receiver are positioned at the exit of a retail establishment and configured to establish a detection zone in which a consumer must pass through as he or she exits the retail establishment. The transmitter is configured to send signals through the detection zone. When an EAS element enters the detection zone, the EAS element responds and creates a signal or a change or disturbance in the original signal transmitted by the transmitter, which is detectable by the receiver. Upon detection of the EAS element, the alarm is triggered in order to notify store personnel that someone is trying to exit the retail establishment with merchandise that has an attached and active EAS element.

Often, security devices are not used for jewelry items that are below a certain value and are displayed on racks or shelves (i.e., not kept in a locked display enclosure). Although each such item may not necessarily be expensive, the theft of these items in the aggregate costs merchants hundreds of thousands of dollars.

Applicant has discovered then that it would be desirable to provide devices and methods for reliably securing an EAS element to small items including articles of jewelry in a simple, cost-effective, and aesthetically pleasing manner. As described in greater detail below, a variety of challenges were identified and overcome through Applicant's efforts to invent and develop such a device.

SUMMARY

Security devices according to the present invention may be configured to secure merchandise supported by a display card. The security device may include a housing defining an aperture configured to receive a secured portion of the article, an engagement member disposed generally proximate the aperture, and a sliding member configured to move the engagement member from the release position to a capture position. The secured portion may be removed from the aperture while the engagement member is in the release position and the secured portion may be inhibited from removal while the engagement member is in the capture position. The engagement member may define an engagement aperture where the secured portion of the article that is received through the aperture of the housing is also received through the engagement aperture of the engagement member.

Security devices of the present invention may further include a locking mechanism that is configurable between a locked position, where the engagement member is fixed in the capture position, and an unlocked position, where the engagement member is free to move to the release position. The locking mechanism may be configured to move from the locked position to the unlocked position in response to an applied magnetic field. The security device may further include a security element. The engagement member may include a first end and a second end, where the sliding member moves the engagement member from the release position to the capture position by engaging the second end to tilt or flex the engagement member. The engagement member may define an engagement aperture, where the secured portion of the article that is received through the aperture of the housing is also received through the engagement aperture of the engagement member, where tilting and/or flexing of the engagement member may cause the engagement aperture to transition from a first effective dimension to a second effective dimension. The engagement member may include a resilient material biased toward the release position. The housing of the security device may be configured to limit movement of the first end of the engagement member relative to the second end of the engagement member.

Example embodiments of the security device may include a housing that defines a second aperture and the security device may include a second engagement member, where the second aperture may be configured to receive a secured portion of a second article when the second engagement member is in a release position and where the security device may be configured to limit removal of the secured portion of the second article from the second aperture when the second engagement member is in a capture position. The sliding member may be configured to move the second engagement member from the release position to the capture position. The display packaging may define a merchandise side and a security device side, where the security device may be configured to be positioned proximate the security device side and where the security device may be generally obscured by the display packaging when the display card is viewed from the merchandise side.

Example embodiments of the present invention may include a security device configured to secure an article supported by display packaging defining a merchandise side and a security device side. The security device may include a housing defining an obscured portion, which is structured for positioning proximate the security device side of the display packaging, and a capture portion which is structured to extend through the display packaging from the security device side to the merchandise side. The capture portion may define an aperture for receiving a secured portion of the article and the obscured portion may at least partially enclose a security element. The security device may further include an engagement member disposed within the housing, the engagement member defining an engagement aperture and where the secured portion of the article that is received through the aperture of the housing is also received through the engagement aperture of the engagement member.

Embodiments of security devices according to the present invention may further include a locking mechanism that is configurable between a locked position in which the engagement member is fixed in a capture position, and an unlocked position in which the engagement member is free to move to a release position. The locking mechanism may be configured to move from the locked position to the unlocked position in response to an applied magnetic field. The security device may further include a sliding member disposed substantially within the housing where the engagement member includes a first end and a second end, and where the sliding member moves the engagement member from a release position to a capture position by engaging the second end to tilt or flex the engagement member. The engagement member may define an engagement aperture where the secured portion of the article that is received through the aperture of the housing may also be received through the engagement aperture of the engagement member, and where tilting and/or flexing of the engagement member may cause the engagement aperture to transition from a first effective dimension to a second effective dimension. The engagement member may include a resilient material that is biased toward the release position.

Embodiments of security devices according to the present invention may also include a housing that is configured to limit movement of the first end of the engagement member relative to the second end of the engagement member. The housing may define a second aperture and the security device may include a second engagement member, where the second aperture is configured to receive a secured portion of a second article when the second engagement member is in a release position and where the security device is configured to limit removal of the secured portion of the second article from the second aperture when the second engagement member is in a capture position. The sliding member may be configured to move the second engagement member from the release position to the capture position.

Security devices according to example embodiments of the present invention may be adapted to secure an article supported by display packaging. The security device may include a housing defining an aperture configured to receive a secured portion of the article and an engagement member at least partially enclosed by the housing and positioned generally proximate the aperture, where the engagement member is configured to be tilted or flexed from a release position, where the secured portion may be removed from the aperture, to a capture position, where the engagement member engages the secured portion to inhibit removal of the secured portion from the aperture. The engagement member may define an engagement aperture and the secured portion of the article that is received through the aperture of the housing may also be received through the engagement aperture of the engagement member.

Security devices according to embodiments of the present invention may further include a locking mechanism that is configurable between a locked position, where the engagement member is fixed in the capture position, and an unlocked position, where the engagement member is free to move to the release position. The locking mechanism may be configured to move from the locked position to the unlocked position in response to an applied magnetic field. The security device may include a security element.

Embodiments of the present invention may further include a sliding member disposed substantially within the housing where the engagement member includes a first end and a second end, where the sliding member moves the engagement member from a release position to a capture position by engaging the second end to tilt or flex the engagement member. The engagement member may define an engagement aperture, where the secured portion of the article that is received through the aperture of the housing is also received through the engagement aperture of the engagement member, and where tilting and/or flexing of the engagement member may cause the engagement aperture to transition from a first effective dimension to a second effective dimension. The engagement member may include a resilient material that is biased toward the release position.

Security devices according to example embodiments of the present invention may be configured such that the housing limits the movement of the first end of the engagement member relative to the second end of the engagement member. The housing may define a second aperture and the security device may include a second engagement member, where the second aperture is configured to receive a secured portion of a second article when the second engagement member is in a release position and where the security device is configured to limit removal of the secured portion of the second article from the second aperture when the second engagement member is in the capture position. The sliding member may be configured to move the second engagement member from the release position to the capture position. The display packaging may define a security device side and a merchandise side, where the security device is configured to be positioned proximate the security device side and where the security device is generally obscured by the display packaging when the display packaging is viewed from the merchandise side.

Example embodiments of security devices according to the present invention may include a benefit denial aspect, wherein the engagement member in the capture position may be configured to secure the secured portion of the article with a force greater than a force required to break at least a portion of the article. The article may be rendered unsatisfactory for its intended purpose in response to forceful attempts to remove the article when the secured portion of the article is engaged by the engagement member in the capture position.

BRIEF DESCRIPTION OF THE SEVERAL VIEWS OF THE DRAWING(S)

Reference will now be made to the accompanying drawings, which are not necessarily drawn to scale, and wherein.

DETAILED DESCRIPTION

Embodiments of the present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout. The terms top, bottom, side, up, down, upwards, downwards, vertical, horizontal, and the like as used below do not imply a required limitation in all embodiments of the present invention but rather are used herein to help describe relative direction or orientation in exemplary embodiments illustrated in the figures.

Embodiments of the present invention provide a security device that is configured to attach to smaller articles, such as earrings or other articles that may be packaged and displayed by attaching to a display card, for example. The term "display packaging" refers to display cards made of card stock, plastic, metal, or other materials, blister packaging, thermoform packaging, or other types of packaging that is configured to support and display an article to a retail customer. As such, the illustrated embodiments should not be limiting with regard to the type of display packaging which may be used in conjunction with example embodiments of the present invention. Security devices as described herein may be attached or proximate to any such display packaging that is compatible with the embodiments described herein.

Small articles that may be packaged and displayed by attaching or positioning proximate to a display card may include necklaces, rings, bracelets, watches, earrings, and other types of jewelry and accessories; however embodiments of the present invention may be particularly beneficial for securing articles with a stem, arm, or post such as earrings. Earrings that may benefit from embodiments of the present invention may include stud-type earrings (with threaded or smooth posts), hoop earrings (with tension, post, or clasp attachment means), dangle earrings (with French-hook or post type attachment means) among many others. Embodiments of the present invention may provide a security device configured to engage various sizes and types of display cards and/or secure articles that include a backing in a relatively unobtrusive manner.

Figure 1:
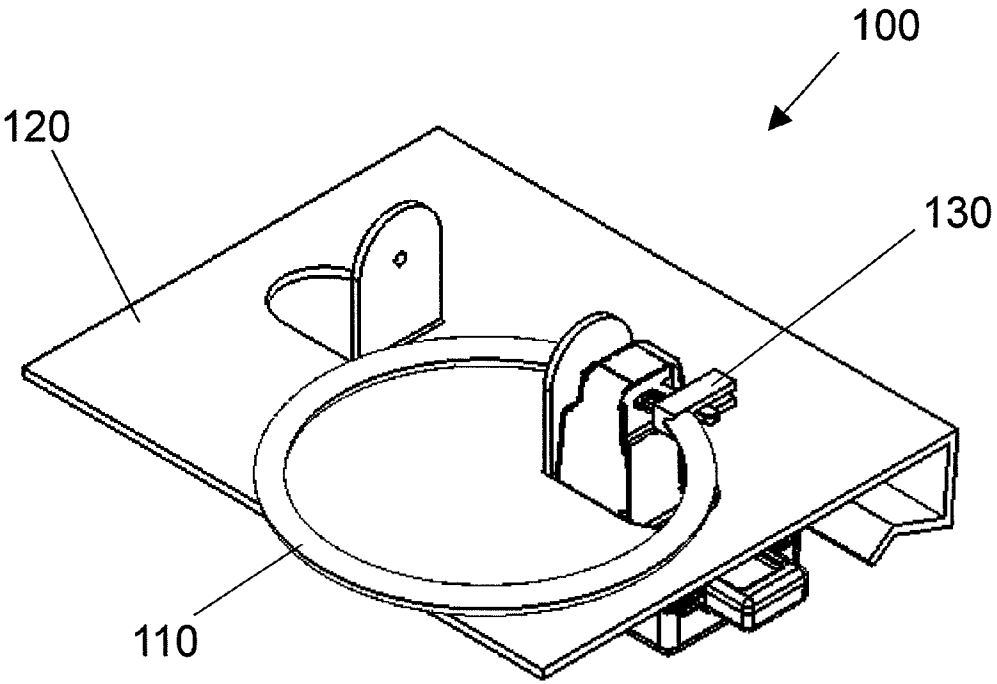
FIG. 1 illustrates a perspective view of an article that is secured by a security device according to example embodiments the present invention.

FIG. 1 illustrates an example embodiment of an article 110 that may be secured by security devices according to example embodiments of the present invention. The article 110 combines with display packaging 120 to form merchandise 100. In the illustrated embodiment, the article 110 includes a hoop-type earring with a clasp 130 attachment means. The depicted display packaging 120 includes a display card configured to be presented on a display rack.

Display racks are commonly located on the display counter of a retail store such that a customer may view the merchandise closely. Further, the merchandise 100 may be accessible to a customer such that they may remove the merchandise 100 from the display rack as accessibility to the article 110 may influence the customer's decision to make a purchase. While the accessibility to the article 110 may be desirable from a sales standpoint, accessibility to the article 110 also makes the article 110 more accessible to potential thieves.

Securing the article 110 with a security device, such as a device comprising an EAS element, an active RFID tag, a passive RFID tag, or similar theft deterrent may be difficult as the article 110 may be small and the security device may detract from the aesthetic appearance of the article 110 and it may obstruct a customer's view of the article 110. A security device, such as an EAS element may be secured to the display packaging 120; however, a would-be thief may only have to remove the article 110 from the display packaging 120 to bypass such a security device.

Figure 2:
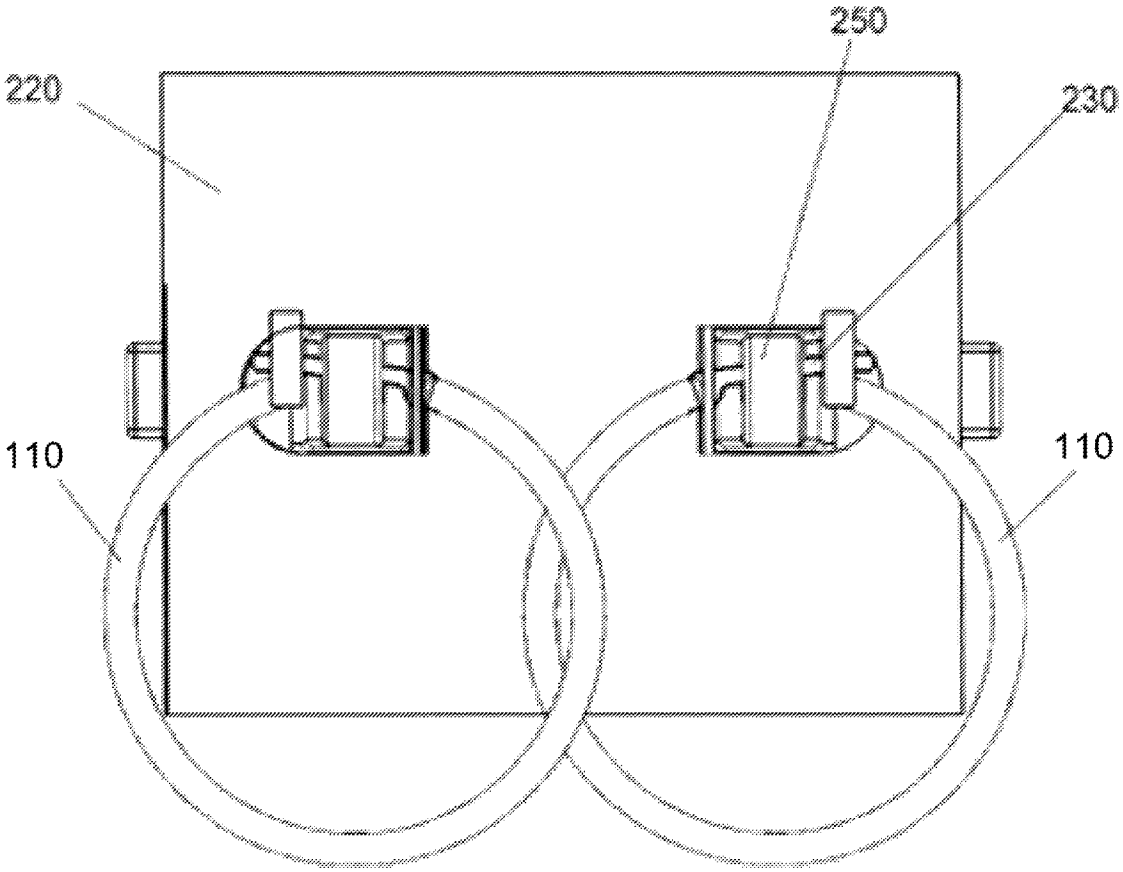
FIG. 2 is a front view of a pair of articles secured by a security device according to an example embodiment of the present invention.

FIG. 2 illustrates an article 110 (depicted as two earrings) secured to a merchandise side of a display packaging 220 (e.g., a display card) with a security device 250 according to an example embodiment of the invention. The earrings include a secured portion 230 (e.g., a clasp in the illustrated embodiment) secured within the security device 250 thereby securing the article 110 to the security device 250. The display packaging 220 is attached to the article 110 in a conventional manner (e.g., the arm of the clasp is inserted through a hole in the display card 220) and the security device 250 is attached through the display packaging 220 to the secured portion 230 the arm of the clasp).

Figure 3:
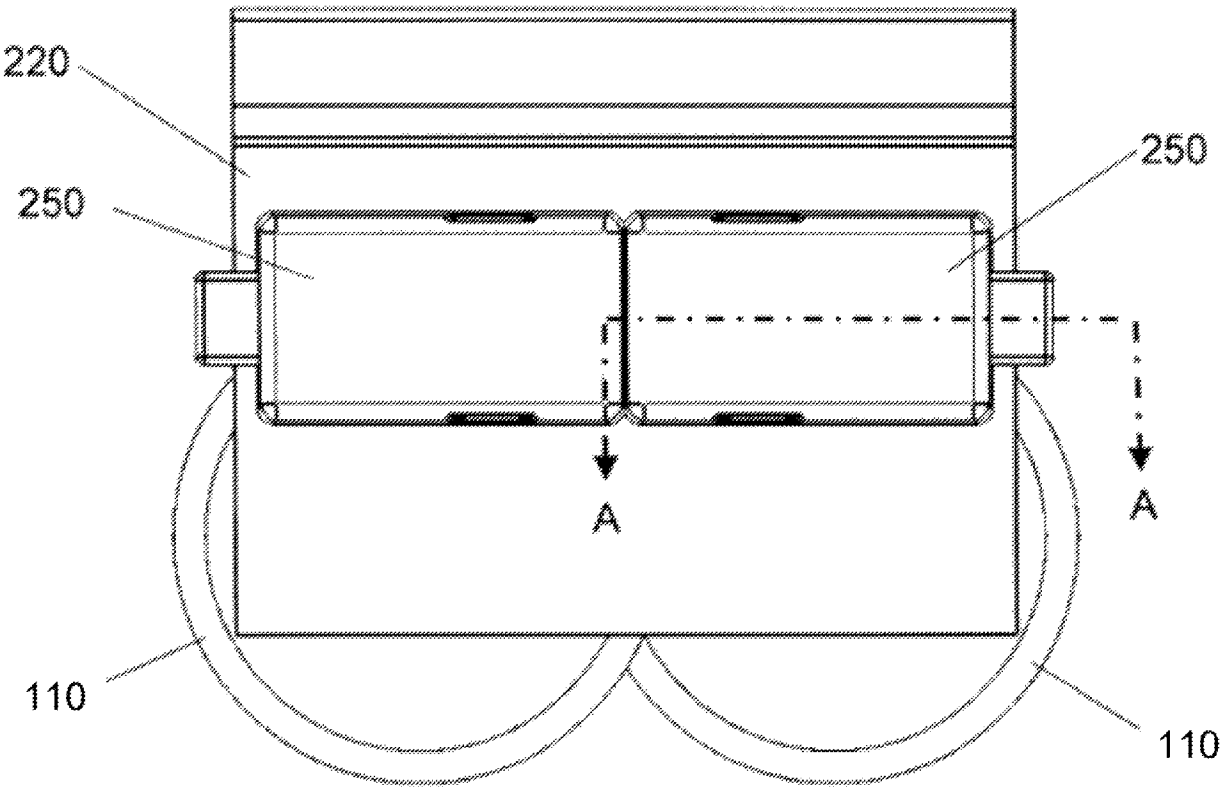
FIG. 3 is a back view of a pair of articles secured by a security device according to an example embodiment of the present invention.
Figure 4:
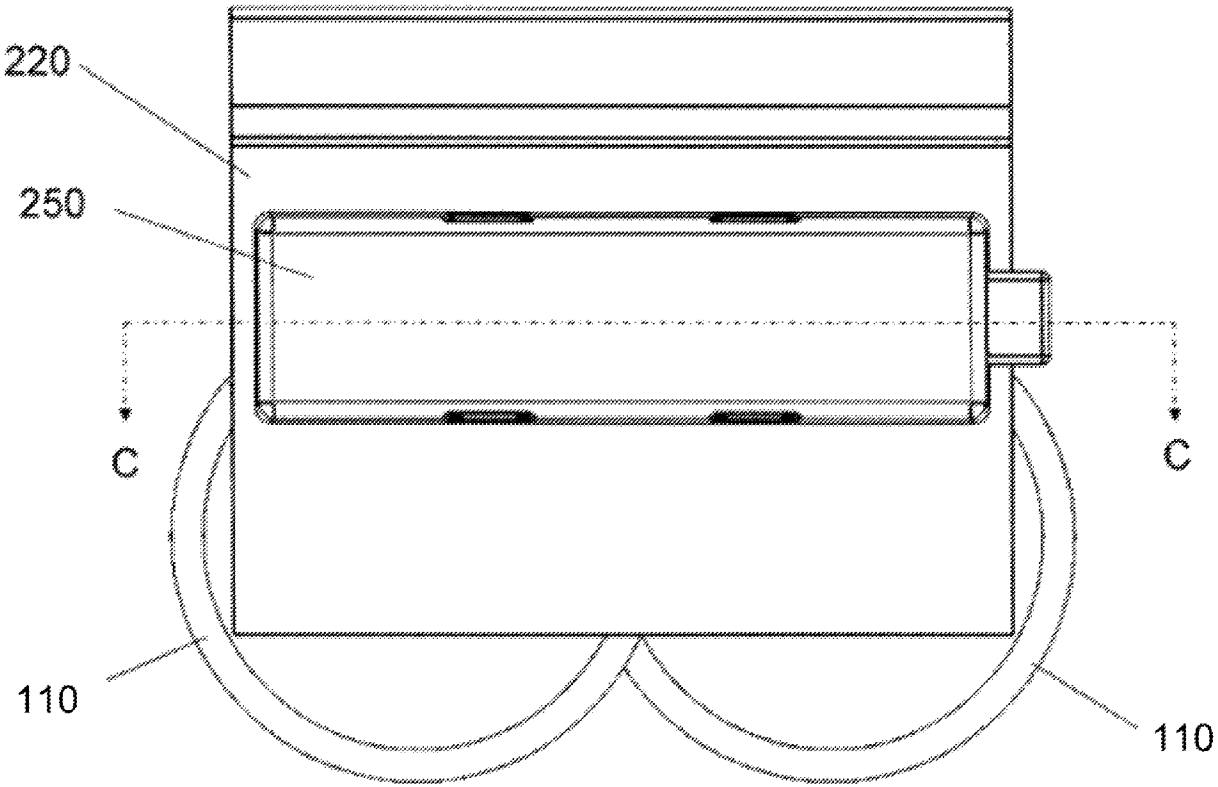
FIG. 4 is a back view of a pair of articles secured by a security device according to another example embodiment of the present invention.

FIG. 3 illustrates the example embodiment of FIG. 2 as viewed from the back, or security device side, of the display packaging 220. A separate security device 250 may be attached to each article 110 as illustrated. FIG. 4 depicts an example embodiment similar to that of FIG. 3; however, a single security device 250 is configured to secure both articles 110. The portion of the security device visible in FIG. 3 may be an obscured portion of the security device, not generally visible from the merchandise side of the display packaging. The obscured portion of the security device is positioned proximate the security device side of the display packaging to make the security device less visible or obtrusive to a customer who may be viewing or handling the display packaging.

Figure 5:
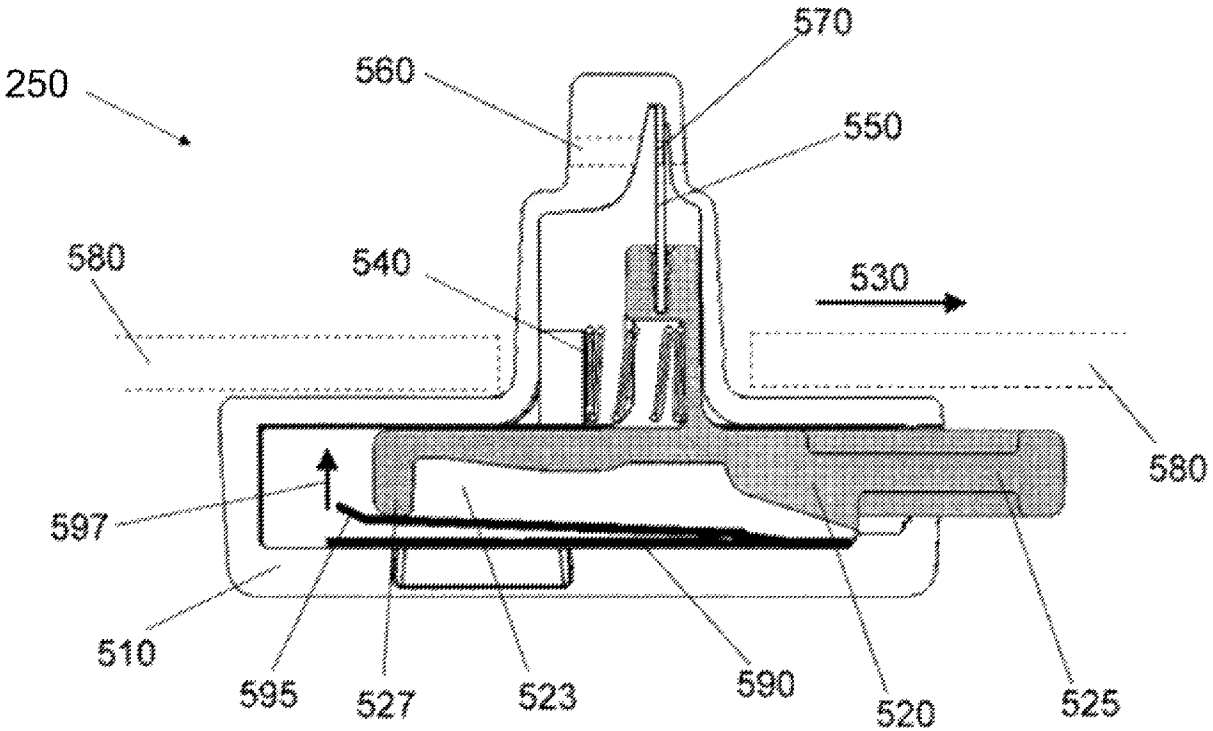
FIG. 5 illustrates a cross-section view of an example embodiment of the security device of FIG. 3 taken along section line A-A, wherein the security device is disposed in a release position.

FIG. 5 illustrates a cross section view of a security device 250 according to the example embodiment of FIG. 3 taken along section line A-A. The depicted security device 250 includes a housing 510 that substantially encloses a sliding element 520. The sliding element 520 is biased in the direction of arrow 530 by a biasing element 540, such as a coil spring. An engagement member 550 is received within the sliding, element 520. The housing 510 includes an aperture 560 that is substantially aligned with an engagement aperture 570 in the engagement member 550. The security device 250 is illustrated as it would pass through the display packaging 580. The embodiment illustrated in FIG. 5 is disposed in a release position with a button portion 525 of the sliding member 520 extending outside of the housing 510. A locking member 590 is depicted within the housing 510. The illustrated locking member 590 is a flat spring with a raised portion 595 configured to be biased in the direction of arrow 597 against the latch portion 527 of the sliding member 520.

Figure 6A:
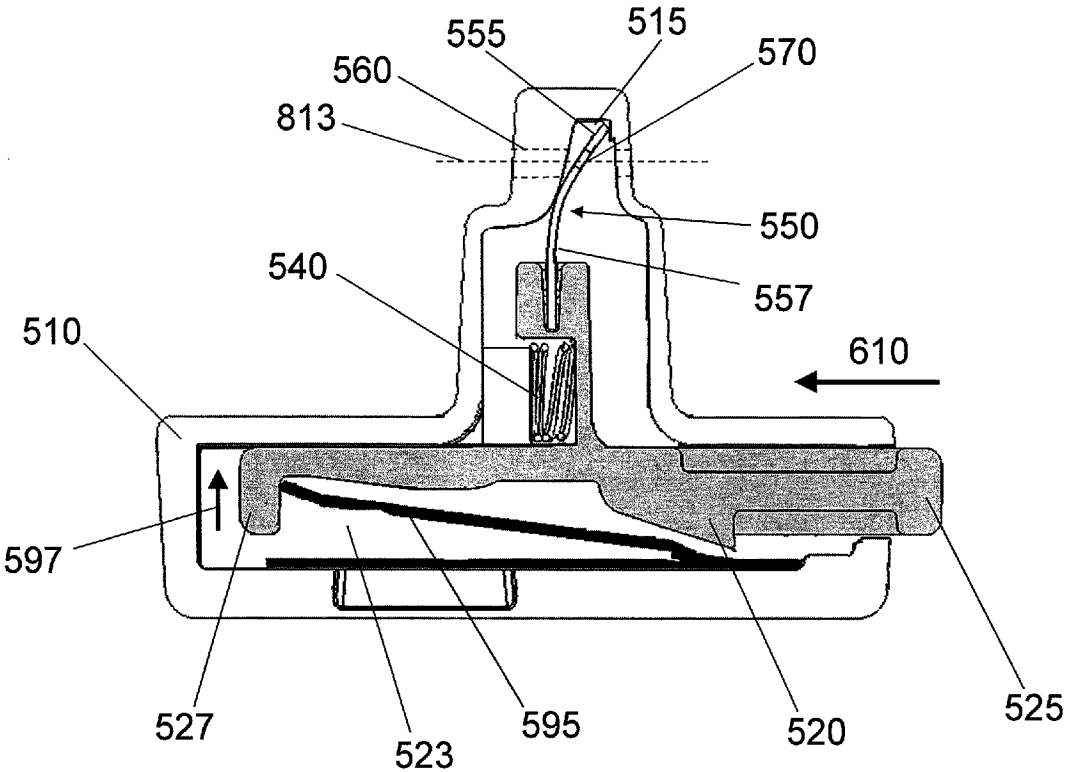
FIG. 6A illustrates a cross-section view of an example embodiment of the security device of FIG. 3 taken along section line A-A, wherein the security device is disposed in a capture position.

When the security device 250 is in the unlocked position, the depicted engagement member 550 may be in a substantially vertical release position. As better illustrated in FIG. 8A, the engagement member 550 defines an engagement aperture 810 which is in substantial alignment with the aperture 560 of the housing 510, FIG. 6A illustrates the security device of FIG. 5 in a locked position. Sliding member 520 is moved from the release position of FIG. 5 to the capture position of FIG. 6A by moving the sliding member 520 in the direction of arrow 610. A user may depress the button portion 525 of the sliding member 520 to move the sliding member from the release position (FIG. 5) to the capture position (FIG. 6A). The sliding member 520 may be advanced in the direction of arrow 610 against the bias of biasing element 540 until the latch portion 527 of the sliding member 520 is advanced past the end of the raised portion 595 of the locking member 590. As the raised portion 595 of the locking member 590 is biased in the direction of arrow 597, once the latch portion 527 is past the end of the raised portion 595 of the locking member 590, the raised portion 595 enters the lock pocket 523 of the sliding member 520. As the raised portion 595 engages the latch portion of the sliding member 520, the sliding member 520 is retained in the capture position by the raised portion 595 of the locking member 590, against the bias of biasing element 540.

In one embodiment, the first end 555 of engagement member 550 is retained within a pocket 515 of the housing 510 such that when the sliding member 520 is advanced in the direction of arrow 610, the movement of the top portion 555 of the engagement member 550 is limited and remains relatively stationary while the second end 557 of the engagement member 550 advances with the sliding member 520. The movement of the second end 557 of the engagement member 550 in response to the sliding member 520 advancing in the direction of arrow 610 causes the engagement member 550 to flex as illustrated, thereby canting or tilting the engagement aperture 570 of the engagement member 550. When the engagement member 550 is flexed by the movement of the sliding member 520 to the capture position, the engagement member 550 is in the capture position.

Figure 6B:
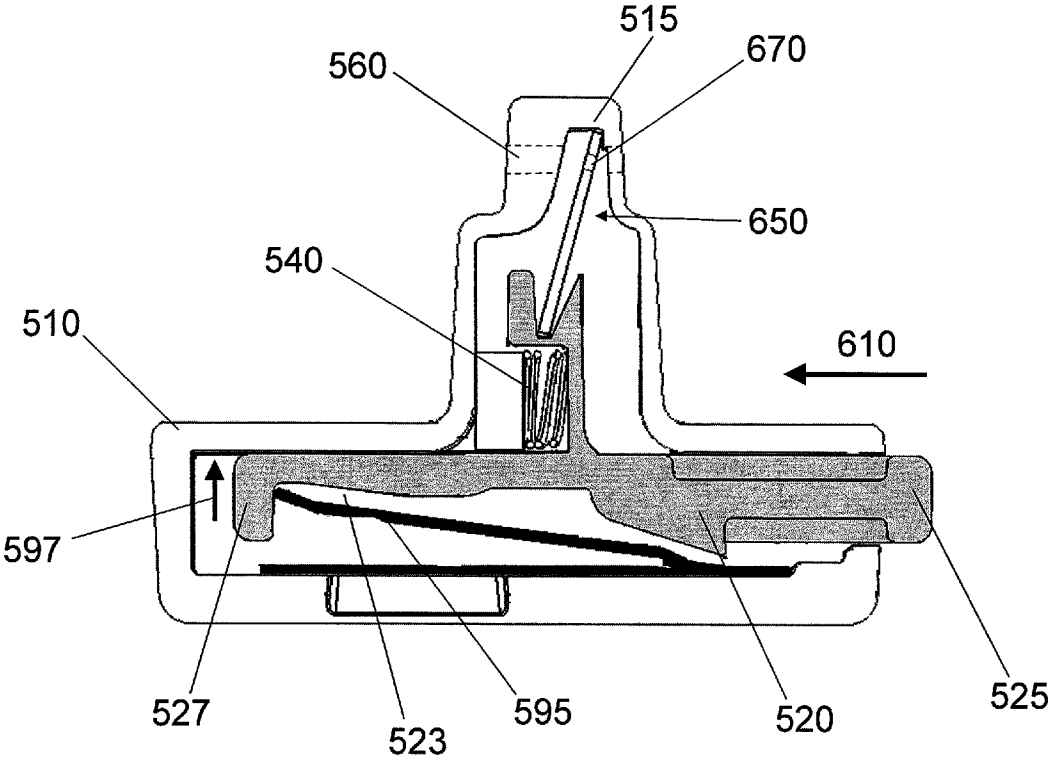
FIG. 6B illustrates a cross-section view of another example embodiment of the security device of FIG. 3 taken along section line A-A, wherein the security device is disposed in a capture position.

While the illustrated embodiment of FIG. 6A depicts a flexible engagement member 550 that may be constructed of a resilient material such as spring steel or similar material, example embodiments of the engagement member may also include a substantially rigid structure. FIG. 6B depicts an example embodiment of an engagement member 650 that is substantially rigid. The engagement member 650 in the release position may be disposed in a position substantially perpendicular to the aperture 560 of the housing 510, wherein an axis disposed through the center of the engagement aperture 670 of the engagement member 650 is substantially parallel to an axis through the center of the aperture 560 in the housing 510. In a capture position, the sliding member 520 may cause the substantially rigid engagement member 650 to tilt to an angle whereby an axis through the center of the engagement aperture 670 of the engagement member 650 is no longer parallel to (i.e., misaligned with) an axis through the center of the aperture 560 through the housing 510.

Figure 6C:
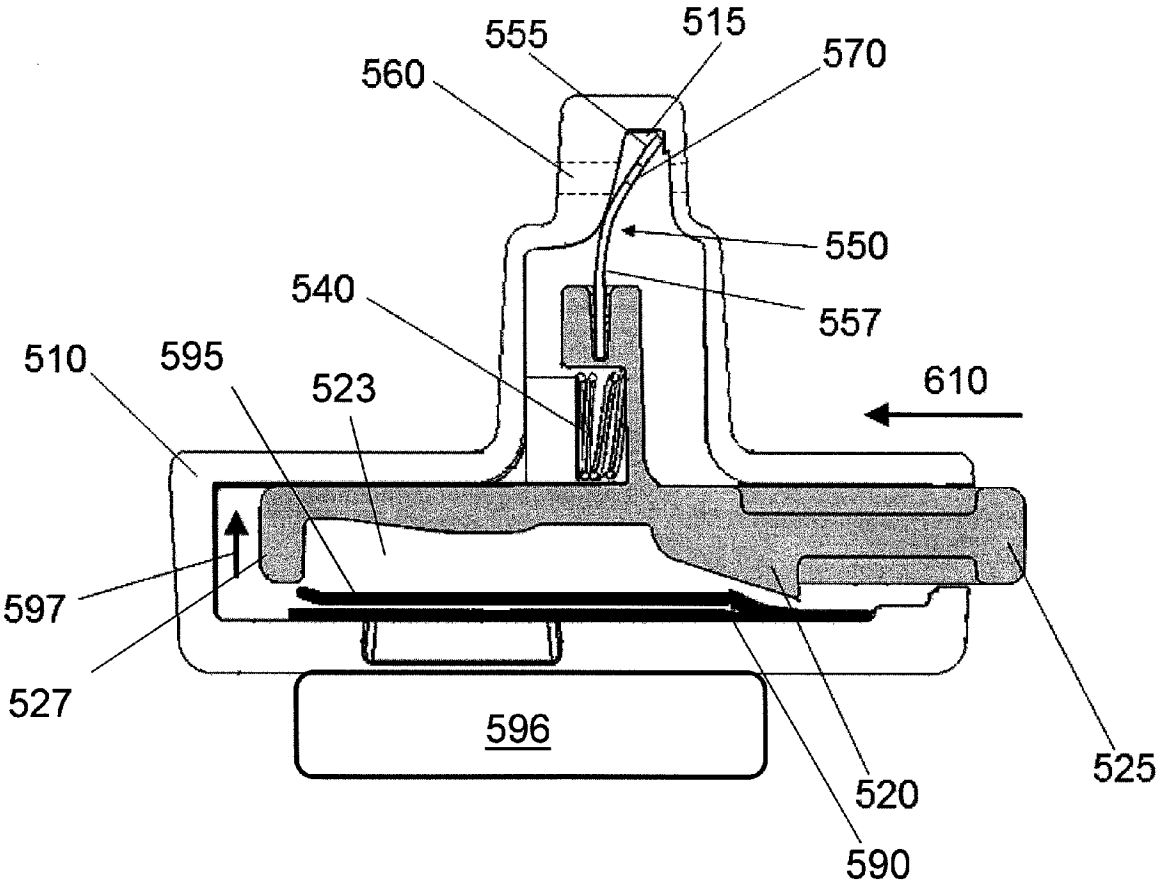
FIG. 6C illustrates a cross-section view of another example embodiment of the security device of FIG. 3 taken along section line A-A, wherein the raised portion of the locking member is in a retracted position.

FIG. 6C illustrates the security device of FIG. 6A with the raised portion 595 of the locking member 590 disposed in a retracted position, thereby allowing the biasing member 540 to drive the sliding element 520 against arrow 610 to the release position. The raised portion 595 may be retracted by a key 596 configured to draw the raised portion 595 against the bias of the raised portion 595, which is in the direction of arrow 597, to the retracted position. The key 596 may include a magnet which may attract a magnetically attractive raised portion 595 towards the key 596. The raised portion 595, or a portion thereof, may include a magnetically attractive material such as a ferrous metal. As the sliding element 520 is biased toward the release position, the sliding element may advance to the release position in response to the raised portion 595 of the locking member 590 being retracted. The key 596 and the housing 510 may each include features that serve to align the key 596 to the housing 510 to ensure appropriate alignment to retract the raised portion 595 of the locking member 590. The alignment features may include raised features of the key 596 or the housing 510 and complementary recesses of the housing 510 or key 596. Optionally, the key may include a mechanical feature which engages the locking member and causes the raised portion 595 to retract to the unlocked position. For example, the key may be applied on a side of the security device and include a protrusion which disengages the raised portion 595 from the sliding element 520.

Figure 12:
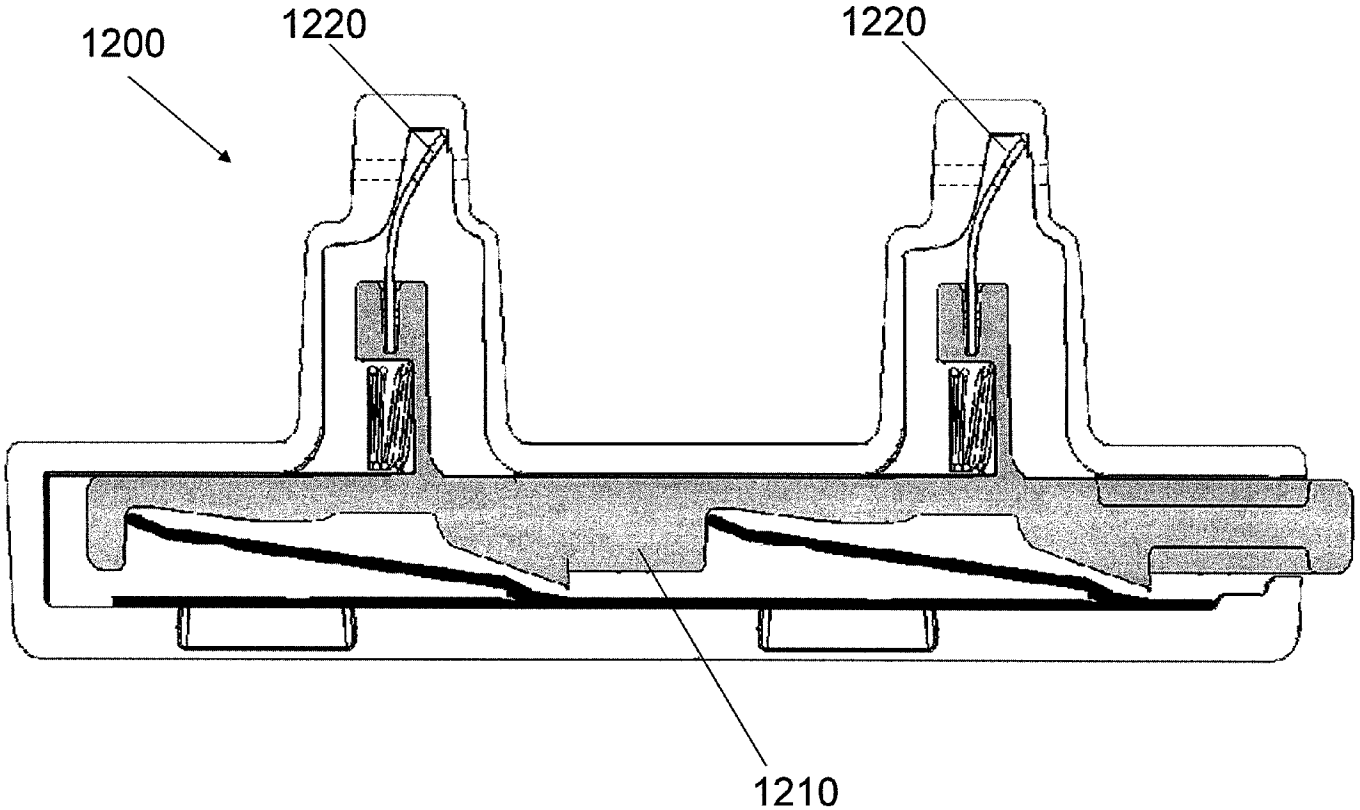
FIG. 12 is a cross sectional view of the security device of FIG. 3 taken along section line C-C.

Example embodiments may include two locking members 590, such as in the embodiment of FIG. 4 (and shown in cross-section in FIG. 12). A key 596 may be configured to retract the raised portions 595 of both locking members 590 substantially simultaneously. Such a key may include two magnets that are aligned with the two locking members. One advantage to such an embodiment may include that the strength of the magnets required to retract the raised portions of the locking members may be sufficient that aligning two such magnets to the two locking members of the security device without a key holding the magnets in place would be very difficult (i.e., the magnetic force applied by each magnet may tend to drive the unrestrained magnets out of position). Thus, necessitating a properly designed key for unlocking the security device.

Figure 7:
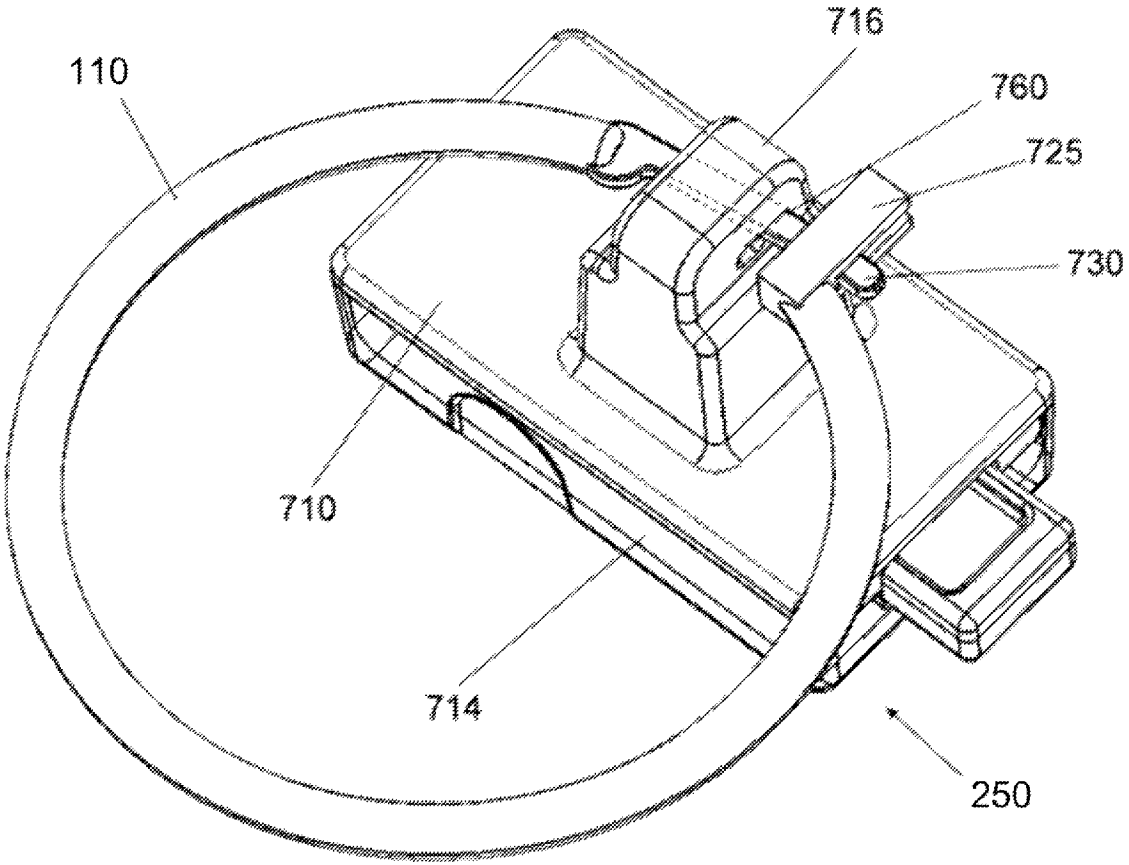
FIG. 7 illustrates a perspective view of an article secured by a security device according to an example embodiment of the present invention with the display packaging omitted.

FIG. 7 illustrates a hoop earring 110 with a clasp 725 including a secured portion 730 as inserted through an aperture 760 of the housing 710 of a security device 250 according to an embodiment of the present invention. The housing may include an obscured portion 714 that is configured to be disposed generally proximate the security device side of display packaging and a capture portion 716 that is configured to extend through the display packaging. As illustrated, the secured portion 730 can be a post, hook, or arm of any type of earring that can be received within the aperture 760 of the security device.

The illustrated embodiment includes a hoop earring 110 with a clasp that includes an arm as the secured portion 730. The secured portion 730 is received through the aperture 760 of the housing 710 and through the engagement aperture of the engagement member (not shown) disposed within the security device 250.

Figure 8B:
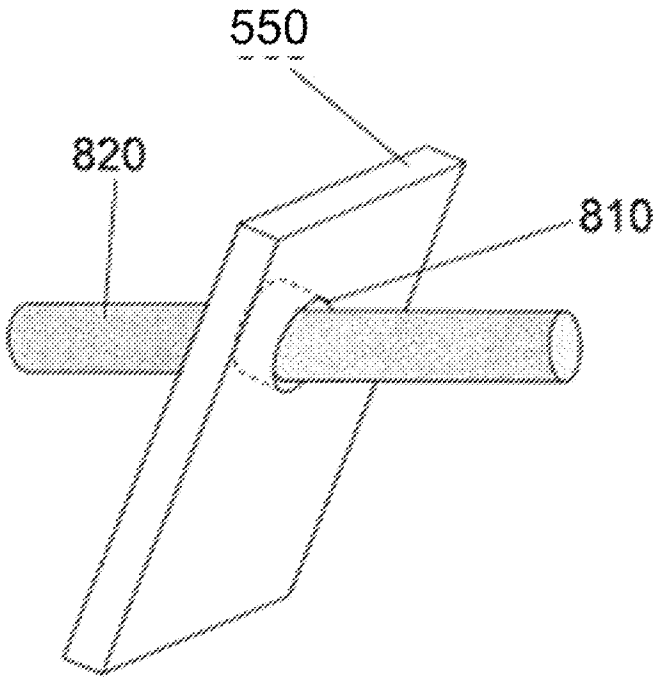
FIG. 8B is a depiction of a secured portion of an article as secured by an engagement member of a security device according to an example embodiment of the present invention.
Figure 8A:
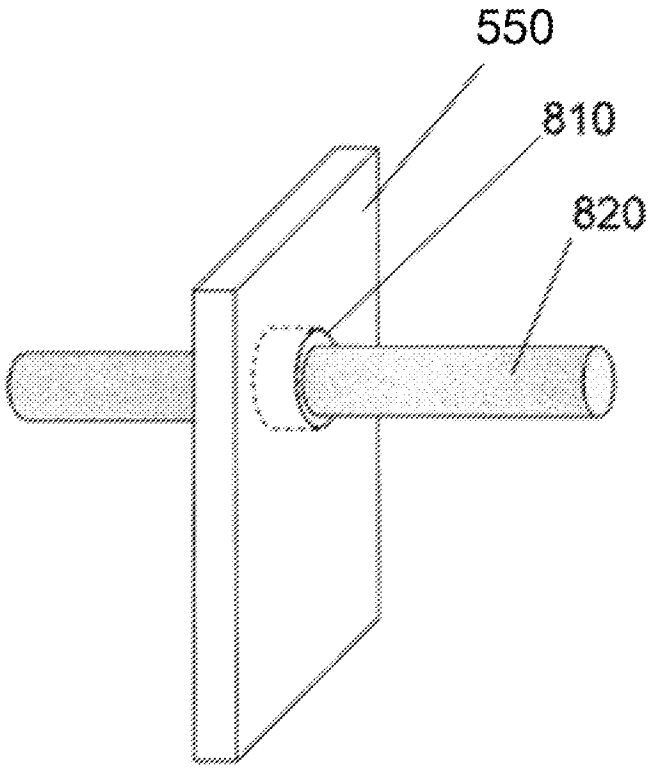
FIG. 8A is a depiction of a portion of an article passing through an engagement member of a security device according to an example embodiment of the present invention.

FIGS. 8A and 8B illustrate an engagement member 550 as described with respect to embodiments of the present invention. The secured portion 820 of an article is illustrated as disposed within the engagement aperture 810 of the engagement member 550. While a secured portion 820 is illustrated as a round post, embodiments of the present invention may receive the post, stem, or arm of any portion of an article of merchandise that may fit through the aperture of the housing and the engagement aperture 810 of the engagement member 550, regardless of the cross-sectional shape of the secured portion (i.e., the cross-sectional shape of the secured portion could be round, square, rectangular, triangular, or other geometric shape, etc.). The engagement aperture 810 is defined by a perimeter that encircles the engagement aperture. Examples of other articles that may be secured by embodiments of the present invention include broaches, pins, tie clips, body-piercing jewelry such as belly-button rings, and other similar articles having, an elongate secured portion extending therefrom.

The illustrated engagement member 550 may be configured to receive the secured portion 820 of an article of merchandise when in the release position illustrated in FIG. 8A. When the engagement member 550 canted in response to the sliding member of the security device advancing from the release position to the capture position as shown in FIG. 8B, the secured portion 820 is engaged by the engagement member 550. The engagement member, in the capture position, firmly grips the secured portion 820 to limit movement of the secured portion 820 within the engagement member 550.

Figure 9B:
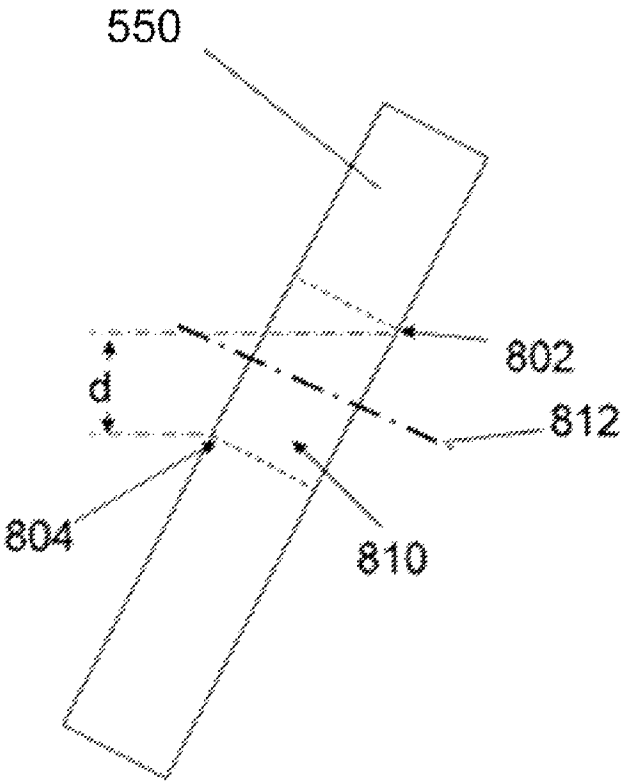
FIG. 9B is an illustration of the effective size of an engagement aperture defined by the engagement member in a release position according to an example embodiment of the present invention.
Figure 9A:
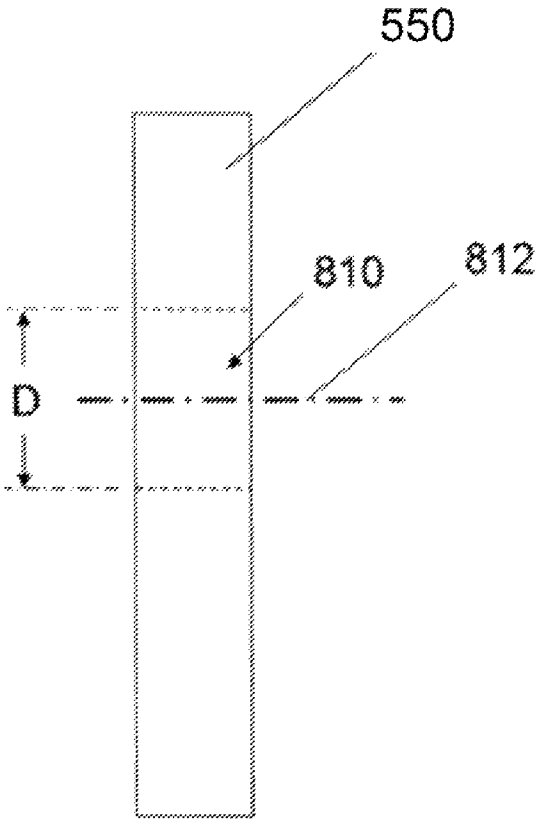
FIG. 9A is an illustration of the effective size of an engagement aperture defined by the engagement member in a release position according to an example embodiment of the present invention.

FIGS. 9A and 9B illustrate the mechanism by which the engagement member 550 engages the secured portion 820 of the article. When the engagement member 550 is in the unflexed or un-canted position of FIGS. 8A and 9A (i.e., when the sliding member is in the release position), the engagement aperture 810 has an effective dimension (e.g., a diameter) of "D". The effective dimension referenced herein is the diameter or height of the engagement aperture of the engagement member as viewed along the axis of the secured portion 820 in line with the aperture of the housing. The aperture may be circular, having a diameter, or it may be of another shape in which the "effective dimension" refers to the largest dimension of an object which may pass through the aperture. When the engagement member 550 is in a flexed or canted position (i.e., when the sliding member is in the capture position), the engagement aperture 810 has a second effective dimension "d" that is smaller than the first effective dimension "D," When the engagement member is moved from the unflexed position (FIGS. 8A, 9A) to the flexed position (FIGS. 8B, 9B), the secured portion 820 is engaged by the distal edge 802 of the perimeter of the top of the engagement aperture 810 and the proximal edge 804 of the perimeter of the bottom of the engagement aperture 810, thereby precluding removal of the post from the engagement aperture 810. Engagement members according to embodiments of the present invention may provide the added benefit that forceful attempts to remove (e.g., pull) a secured portion of an article from the security device may cause the engagement member to more firmly engage the secured portion. In response to a secured member that is engaged by an engagement member being pulled in an attempt to remove the article from the security device, the engagement member may be further flexed, thereby reducing the effective dimension and causing the edges 802, 804 of the perimeter of the aperture 810 to dig further into the secured portion and resist removal with greater force.

The engagement member 550 may engage the secured portion 820 with enough force to cause the security device to function as a benefit denial security device. Forceful attempts to remove the secured portion 820 from the security device may cause the secured article to break. For example, the secured portion 820 of the article may break away from the article rendering the earring unusable; hence, the benefit of stealing the article is denied. Attempts to remove the article from the security device when a secured portion of the article is engaged by the engagement member in the capture position may render the article unsatisfactory for its intended use. For example, a post may break away from an earring, rendering it unsatisfactory for its intended use. Further, a secured article may be bent or otherwise marred by forceful attempts to remove the secured portion from the security device, thereby rendering the article unsatisfactory for its intended purpose.

The engagement aperture 810 of FIG. 9A may define an axis 812 that is defined as the axis along which a secured article is received when the engagement member 550 is in the release position. The axis 812 is substantially aligned with an axis 813 defined through aperture 560 of the housing (see FIG. 6A) when the sliding member is in the release position and the engagement member is in the un-canted, un-flexed position. The axis 812 of the engagement aperture 810 of FIG. 9B is substantially askew or misaligned from the axis 813 defined through aperture 560 of the housing when the sliding member is in the capture position and the engagement member is in the canted or flexed position.

While the illustrated embodiments depict an engagement member with an engagement aperture that is tilted by virtue of a sliding member moving one end of the engagement member, it may be appreciated that other methods of tilting the engagement aperture may also secure a secured portion of an article within a security device. For example, the engagement member may be twisted within the housing such that the engagement aperture is tilted away from alignment with the aperture of the housing along an axis that is substantially perpendicular to the illustrated embodiment. The engagement member may be twisted by a dial that engages a ratchet to hold the engagement member in a capture position in such an embodiment. Further, another example embodiment (not shown) may include an engagement member structured to at least partially extend from the housing to define a grip portion that may be grasped by a user to manually tilt or cant the engagement aperture relative to the aperture of the housing.

The engagement member 550 may be configured to secure secured portions 820 of various sizes. A single size of engagement member may secure a range of sizes of secured portions 820 or other article portions. For example, a single engagement member may be configured to secure earrings with posts of gages 24-16 (i.e., 0.5 millimeters to 1.3 millimeters). The engagement aperture 810 in the engagement member may be a predetermined percentage (e.g., 25%) bigger than the largest size secured portion 820 that is to be secured, and no more than a predetermined percentage larger than the smallest size secured portion 820 that is to be secured (e.g., 200%). The adjustability of security devices according to embodiments of the present invention may include the sliding distance of the sliding member, for example a larger diameter post may only require the sliding member to be slid a small amount while a smaller diameter post may require the sliding member to be slid a greater amount. The distance that the sliding member slides corresponds to the angle at which the engagement member is canted or flexed and therefore the effective dimension of the engagement aperture in the capture position. The sliding member may be configured with a lock pocket that contains a ratchet surface to provide various locking positions of the sliding member (i.e., to account fix secured portions of various diameters).

While the engagement aperture has been referenced to have an effective dimension or diameter, it is noted that the engagement aperture may be circular, oblong, rectangular, square, triangular, or any desired shape. Further, the secured portion engaged by the engagement member may be of any shape that may fit within the engagement aperture of the engagement member. The engagement member may be made of any suitable material, but is preferably a durable material, such as steel, such that the edges 802, 804, that engage the post are resistant to wear and have the ability to "bite" into or grip a softer material, such as a gold or silver alloy as may be typically used in articles secured by example embodiments of security devices of the present invention. Example embodiments of the engagement member that are flexible engagement members may use a material such as spring steel, that is both durable and somewhat flexible, while rigid engagement members may be made of steel or any substantially rigid (e.g., non-flexible) material that can be used in accordance with embodiments of the present invention to grip the secured portion of the article.

Figure 10:
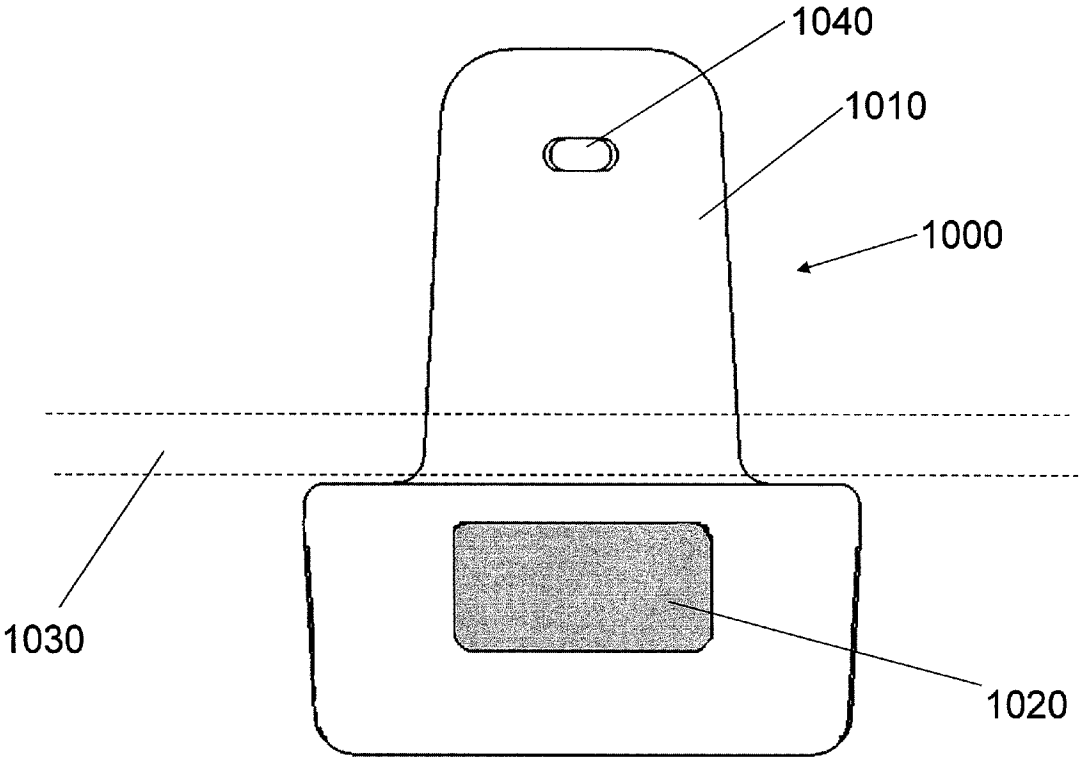
FIG. 10 is a side view of a security device according to an example embodiment of the present invention.
Figure 11:
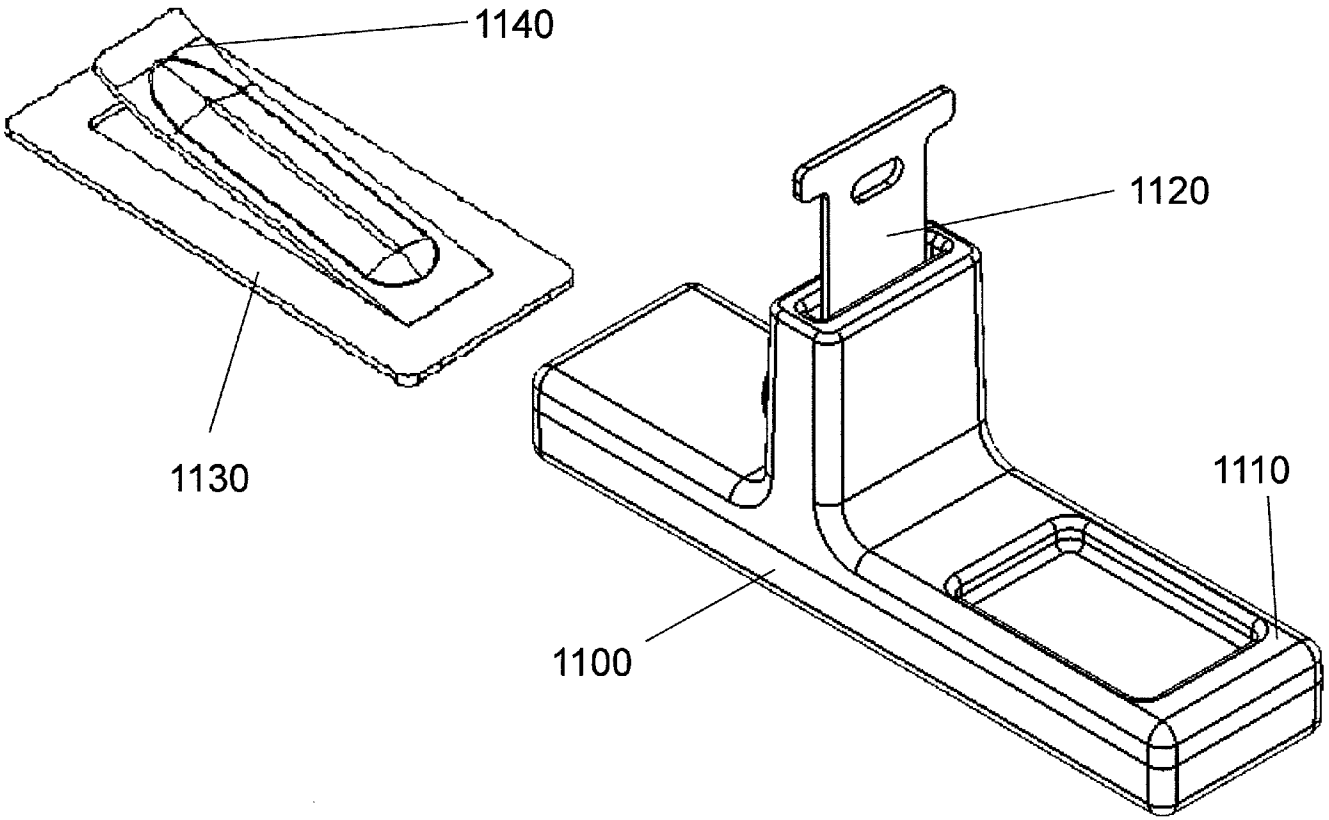
FIG. 11 illustrates a perspective view of the sliding member and the locking member of a security device according to an example embodiment of the present invention.

FIG. 10 illustrates an end view of a security device 1000 according to example embodiments of the present invention. The security device 1000 includes a housing 1010 that has an aperture 1040. The security device 1000 further includes sliding member 1020. A display card 1030 is illustrated for reference. FIG. 11 illustrates an example embodiment of a sliding member 1100 including button portion 1110. The engagement member 1120 is received within the sliding member such that the portion disposed within the sliding member slides with the sliding member 1100 between the release position and capture positions. Further illustrated is an example embodiment of a locking member 1130 including raised portion 1140 configured to engage a lock pocket (not shown) disposed within the sliding member 1100.

FIG. 12 illustrates another example embodiment of a security device according to the present invention which is configured to secure two articles of merchandise, such as a pair of earrings. The embodiment of FIG. 12 is similar to embodiments outlined in FIGS. 1-11; however, the sliding member 1210 engages two engagement members 1220 that are each configured to receive and secure an article substantially simultaneously.

Figure 13:
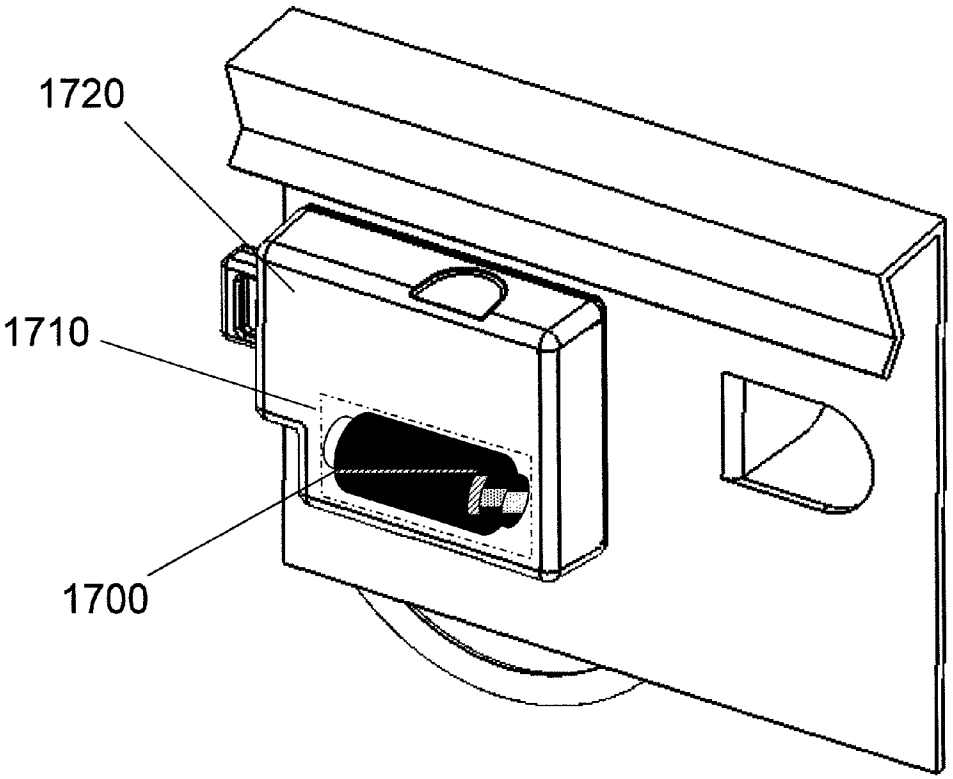
FIG. 13 illustrates a perspective view of the back of display packaging containing an article of merchandise secured by security devices according to example embodiments of the present invention comprising a security element.

Example embodiments of security devices according to the present invention may further include a security element such as an electronic article surveillance (EAS) element. FIG. 13 illustrates an example embodiment similar to the embodiment of FIG. 1 including an EAS element 1700. In the depicted embodiment, a cutaway 1710 of the security device 1720 reveals an EAS element 1700. The EAS element may be incorporated in any number of positions and locations within or on security devices according to the present invention and the example depicted in FIG. 13 is for illustration of a possible location and position for such an EAS element. In this regard, the security device 1710 may include an EAS element 1700 that is configured to be detectable when the EAS element 1700 is present in a predetermined detection zone, such as a zone set up at or near the door or other entrance point of the retail establishment. The EAS element 1700 may be configured to work within an EAS security system. For example, the EAS element 1700 may include a magnetic tag, such as in an electromagnetic (EM) system or in an acousto-magnetic (AM) system, or the EAS element may include an electronic circuit and antenna, such as in a radio frequency (RF) system. As another example, the EAS element 1700 may be configured work within a microwave system.

In addition to or instead of the EAS element 1700, the security device may include other wireless devices. For example, the security device may include an active or passive RFID tag. The RFID tag may be used to store and/or communicate information about the object for security or inventory control purposes. Optionally, the display packaging itself may include a security element (e.g., and EAS element) embedded in the display packaging, such as laminated between layers of the material that makes up the display card. Such an embodiment may be used in place of, or in conjunction with, a security element within the security device.

Although the depicted embodiment shows a security device that may be configured for one-alarm functionality (i.e., an alarm is triggered when the security device approaches or passes by a security gate), in other embodiments not shown further components may be included for providing two- or three-alarm functionality. Such components may include a printed circuit board that includes electrical circuitry for supporting various functions of the security device. For example, the electrical circuitry may be connected to a sensor that detects any discontinuity (such as opening of the security device without a key) is recognized as a fault condition, which triggers alarm functionality, such as the sounding of a piezoelectric speaker or the lighting of an LED. Therefore, in some embodiments, the security device may have three alarm features: (1) the gates themselves alarming when the EAS element 1700 is detected; (2) the audible alarm (e.g., a piezoelectric speaker) of the security device itself triggering when the security device is forced open or otherwise tampered with; and (3) the audible alarm (e.g., a piezoelectric speaker) of the security device triggering when the EAS element is at, near, or beyond the security gates.

Embodiments of a security device have been described above with respect to FIGS. 1-13 in which the article to be secured is attached to display packaging. Other embodiments of the present invention may be configured such that the security device may secure the item regardless of the presence of a display card. The security device itself could be configured to serve as both the display card and the security device.

One skilled in the art would appreciate the other improvements and enhancements that the security device, according to embodiments of the present invention, provides over some of the conventional security devices. Many modifications and other embodiments of the inventions set forth herein will come to mind to one skilled in the art to which these inventions pertain having the benefit of the teachings presented in the foregoing descriptions and the associated drawings.

Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A security device adapted to secure an article supported by display packaging, the security device comprising:

a housing defining an aperture configured to receive a secured portion of the article;

an engagement member disposed generally proximate the aperture;

a sliding member configured to move the engagement member from a release position, wherein the secured portion may be removed from the aperture, to a capture position, wherein the engagement member engages the secured portion to inhibit removal of the secured portion from the aperture;

a locking mechanism that is configured between a locked position, wherein the engagement member is fixed in the capture position, and an unlocked position, wherein the engagement member is free to move to the release position; and wherein the locking mechanism is configured to move from the locked position to the unlocked position in response to an applied key.

2. The security device of claim 1, wherein the engagement member defines an engagement aperture and wherein the secured portion of the article that is received through the aperture of the housing is also received through the engagement aperture of the engagement member.

3. The security device of claim 1 further comprising a security element.

4. The security device of claim 1, wherein the engagement member comprises a first end and a second end, wherein the sliding member moves the engagement member from the release position to the capture position by engaging the second end to tilt or flex the engagement member.

5. The security device of claim 4, wherein the engagement member defines an engagement aperture, wherein the secured portion of the article that is received through the aperture of the housing is also received through the engagement aperture of the engagement member, and wherein tilting or flexing of the engagement member causes the engagement aperture to transition from a first effective dimension to a second effective dimension.

6. The security device of claim 4, wherein the engagement member is comprised of a resilient material biased toward the release position.

7. The security device of claim 4, wherein the housing is configured to limit movement of the first end of the engagement member relative to the second end of the engagement member.

8. The security device of claim 1, wherein the housing defines a second aperture and the security device includes a second engagement member, wherein the second aperture is configured to receive a secured portion of a second article when the second engagement member is in a release position and wherein the security device is configured to limit removal of the secured portion of the second article from the second aperture when the second engagement member is in a capture position.

9. The security device of claim 8, wherein the sliding member is configured to move the second engagement member from the release position to the capture position.

10. The security device of claim 1, wherein the display packaging defines a merchandise side and a security device side, wherein the security device is configured to be positioned proximate the security device side, and wherein the security device is generally obscured by the display packaging when the display packaging is viewed from the merchandise side.

11. A security device configured to secure an article supported by display packaging defining a merchandise side and a security device side, the security device comprising:

a housing defining an obscured portion, which is structured for positioning proximate the security device side of the display packaging;

a capture portion, which is structured to extend through the display packaging from the security device side to the merchandise side, wherein the capture portion defines an aperture for receiving a secured portion of the article, and wherein the obscured portion at least partly encloses a security element;

an engagement member disposed within the housing, the engagement member defining an engagement aperture and wherein the secured portion of the article that is received through the aperture of the housing is also received through the engagement aperture of the engagement member; and a sliding member disposed substantially within the housing, wherein the engagement member comprises a first end and a second end, and wherein the sliding member moves the engagement member from a release position to a capture position by engaging the second end to tilt or flex the engagement member.

12. The security device of claim 11 further comprising a locking mechanism that is configurable between a locked position, wherein the engagement member is fixed in a capture position, and an unlocked position, wherein the engagement member is free to move to a release position.

13. The security device of claim 12, wherein the locking mechanism is configured to move from the locked position to the unlocked position in response to an applied key.

14. The security device of claim 11, wherein the engagement member defines an engagement aperture, wherein the secured portion of the article that is received through the aperture of the housing is also received through the engagement aperture of the engagement member, and wherein tilting or flexing of the engagement member causes the engagement aperture to transition from a first effective dimension to a second effective dimension.

15. The security device of claim 11, wherein the engagement member is comprised of a resilient material biased toward the release position.

16. The security device of claim 11, wherein the housing is configured to limit movement of the first end of the engagement member relative to the second end of the engagement member.

17. The security device of claim 11, wherein the housing defines a second aperture and the security device includes a second engagement member, wherein the second aperture is configured to receive a secured portion of a second article when the second engagement member is in a release position and wherein the security device is configured to limit removal of the secured portion of the second article from the second aperture when the second engagement member is in a capture position.

18. The security device of claim 17, wherein the sliding member is configured to move the second engagement member from the release position to the capture position.

19. A security device adapted to secure an article supported by display packaging, the security device comprising:

a housing defining an aperture configured to receive a secured portion of the article; and an engagement member at least partly enclosed by the housing and positioned generally proximate the aperture, wherein the engagement member is configured to be tilted or flexed from a release position, wherein a secured portion of the article may be removed from the aperture, to a capture position, wherein the engagement member engages the secured portion to inhibit removal of the secured portion from the aperture;

wherein the display packaging defines a merchandise side and security device side, wherein the security device is configured to be positioned proximate the security device side, and wherein the security device is generally obscured by the display packaging when the display packaging is viewed from the merchandise side.

20. The security device of claim 19, wherein the engagement member defines an engagement aperture and wherein the secured portion of the article that is received through the aperture of the housing is also received through the engagement aperture of the engagement member.

21. The security device of claim 19 further comprising a locking mechanism that is configurable between a locked position, wherein the engagement member is fixed in the capture position, and an unlocked position, wherein the engagement member is free to move to the release position.

22. The security device of claim 20, wherein the locking mechanism is configured to move from the locked position to the unlocked position in response to an applied key.

23. The security device of claim 19 further comprising a security element.

24. The security device of claim 19, further comprising a sliding member disposed substantially within the housing, wherein the engagement member comprises a first end and a second end, and wherein the sliding member moves the engagement member from a release position to a capture position by engaging the second end to tilt or flex the engagement member.

25. The security device of claim 24, wherein the engagement member defines an engagement aperture, wherein the secured portion of the article that is received through the aperture of the housing is also received through the engagement aperture of the engagement member, and wherein tilting or flexing of the engagement member causes the engagement aperture to transition from a first effective dimension to a second effective dimension.

26. The security device of claim 24, wherein the engagement member is comprised of a resilient material biased toward the release position.

27. The security device of claim 24, wherein the housing is configured to limit movement of the first end of the engagement member relative to the second end of the engagement member.

28. The security device of claim 24, wherein the housing defines a second aperture and the security device includes a second engagement member, wherein the second aperture is configured to receive a secured portion of a second article when the second engagement member is in a release position and wherein the security device is configured to limit removal of the secured portion of the second article from the second aperture when the second engagement member is in a capture position.

29. The security device of claim 28, wherein the sliding member is configured to move the second engagement member from the release position to the capture position.

30. The security device of claim 19, wherein the engagement member in the capture position is configured to secure the secured portion of the article with a force greater than a force required to break at least a portion of the article.

31. The security device of claim 19, wherein the article is rendered unsatisfactory for its intended purpose in response to forceful attempts to remove the article when the secured portion is engaged by the engagement member in the capture position.

* * * * *